US010808207B2

(12) United States Patent
Souter et al.

(10) Patent No.: US 10,808,207 B2
(45) **Date of Patent: *Oct. 20, 2020**

(54) AUTOMATIC DISHWASHING DETERGENT COMPOSITION

(71) Applicant: The Procter & Gamble Company, Cincinnati, OH (US)

(72) Inventors: Philip Frank Souter, Northumberland (GB); Alan Thomas Brooker, Newcastle upon Tyne (GB); Lindsay Suzanne Bewick, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 124 days.

This patent is subject to a terminal disclaimer.

(21) Appl. No.: 15/364,282

(22) Filed: Nov. 30, 2016

(65) Prior Publication Data

US 2017/0175045 A1 Jun. 22, 2017

(30) Foreign Application Priority Data

Dec. 17, 2015 (EP) ..... 15200971

(51) Int. Cl.

| | |
|---|---|
| ***C11D 1/72*** | (2006.01) |
| ***C11D 1/722*** | (2006.01) |
| ***C11D 3/20*** | (2006.01) |
| ***C11D 3/395*** | (2006.01) |
| ***C11D 3/50*** | (2006.01) |
| ***C11D 3/37*** | (2006.01) |
| ***C11D 17/04*** | (2006.01) |
| ***C11D 3/00*** | (2006.01) |
| ***C11D 3/30*** | (2006.01) |
| ***C11D 3/39*** | (2006.01) |
| ***C11D 3/386*** | (2006.01) |

(52) U.S. Cl.

CPC ..... *C11D 3/50* (2013.01); *C11D 1/72* (2013.01); *C11D 1/721* (2013.01); *C11D 1/722* (2013.01); *C11D 3/0036* (2013.01); *C11D 3/0047* (2013.01); *C11D 3/2075* (2013.01); *C11D 3/2082* (2013.01); *C11D 3/30* (2013.01); *C11D 3/3723* (2013.01); *C11D 3/38609* (2013.01); *C11D 3/38672* (2013.01); *C11D 3/3902* (2013.01); *C11D 3/3935* (2013.01); *C11D 3/3942* (2013.01); *C11D 17/042* (2013.01); *C11D 17/045* (2013.01)

(58) Field of Classification Search

CPC ..... C11D 3/2075; C11D 3/2082; C11D 1/71; C11D 1/722; C11D 3/30; C11D 3/38609; C11D 3/3902; C11D 3/3942; C11D 3/3935; C11D 17/045; C11D 3/38672; C11D 3/03; C11D 3/3723

USPC ..... 510/223, 224, 226, 229, 375, 439, 441, 510/445, 446, 475, 499, 505, 506, 391, 510/392

See application file for complete search history.

(56) References Cited

U.S. PATENT DOCUMENTS

| | | | | |
|---|---|---|---|---|
| 4,587,031 | A | 5/1986 | Kruse et al. | |
| 5,259,994 | A | 11/1993 | Welch et al. | |
| 5,292,446 | A | 3/1994 | Painter et al. | |
| 5,529,715 | A | 6/1996 | Kuroda et al. | |
| 5,559,089 | A | 9/1996 | Hartman et al. | |
| 5,616,277 | A | 4/1997 | Raleigh et al. | |
| 5,650,017 | A | 7/1997 | Gordon et al. | |
| 5,654,265 | A | 8/1997 | Kuroda et al. | |
| 5,663,133 | A | 9/1997 | Goldstein | |
| 5,698,504 | A | 12/1997 | Christie et al. | |
| 5,698,507 | A | 12/1997 | Gorlin et al. | |
| 5,747,438 | A | 5/1998 | MacBeath | |
| 5,786,314 | A | 7/1998 | Sadlowski | |
| 6,544,943 | B1 | 4/2003 | Ricci et al. | |
| 6,602,841 | B1 * | 8/2003 | Becker | C11D 3/38672 510/392 |
| 7,030,068 | B2 | 4/2006 | Clare | |
| 7,153,817 | B2 | 12/2006 | Binder | |
| 7,425,527 | B2 | 9/2008 | Miracle | |
| 8,173,587 | B2 | 5/2012 | Preuschen | |
| 8,841,245 | B2 | 9/2014 | Scialla et al. | |
| 10,421,927 | B2 * | 9/2019 | Souter | C11D 17/045 |
| 2002/0019325 | A1 | 2/2002 | Olsen | |
| 2003/0050209 | A1 | 3/2003 | Perkis et al. | |
| 2003/0073598 | A1 | 4/2003 | Coggeshall et al. | |
| 2003/0092595 | A1 | 5/2003 | Romero et al. | |
| 2003/0100473 | A1 | 5/2003 | Kischkel et al. | |

(Continued)

FOREIGN PATENT DOCUMENTS

| | | | |
|---|---|---|---|
| DE | 42 10 363 | A1 | 10/1993 |
| EP | 0 504 091 | A1 | 9/1992 |

(Continued)

OTHER PUBLICATIONS

U.S. Appl. No. 15/364,280, filed Nov. 30, 2016, Souter, et al.

(Continued)

*Primary Examiner* — Gregory R Delcotto

(74) *Attorney, Agent, or Firm* — Abbey A. Lopez

(57) ABSTRACT

A neutral or acidic automatic dishwashing detergent composition including a pH regulator system and a cleaning agent selected from the group consisting of cleaning surfactants, soil suspending polymers and mixtures thereof wherein the weight ratio of the pH regulator system to the cleaning agent is from 3:1 to 1:1 system and wherein the detergent composition includes from 0.01% to 5% by weight of the composition of a perfume.

10 Claims, No Drawings

(56) References Cited

U.S. PATENT DOCUMENTS

| | | | | |
|---|---|---|---|---|
| 2003/0171245 | A1 | 9/2003 | Goovaerts et al. | |
| 2004/0167051 | A1 | 8/2004 | Kessler | |
| 2007/0000067 | A1 | 1/2007 | Shi et al. | |
| 2009/0011971 | A1 | 1/2009 | Evers | |
| 2009/0264332 | A1 | 10/2009 | Yoshikawa et al. | |
| 2009/0325840 | A1 | 12/2009 | Preuschen | |
| 2010/0190677 | A1 | 7/2010 | Esposito et al. | |
| 2011/0207647 | A1 | 8/2011 | Preuschen | |
| 2011/0212876 | A1* | 9/2011 | Meek | C11D 3/33 510/393 |
| 2011/0263474 | A1 | 10/2011 | Somerville Roberts et al. | |
| 2011/0281783 | A1 | 11/2011 | Soentgerath | |
| 2012/0053108 | A1* | 3/2012 | Glenn, Jr. | A61L 27/50 510/296 |
| 2012/0058266 | A1 | 3/2012 | Chambers et al. | |
| 2012/0067373 | A1 | 3/2012 | Souter et al. | |
| 2012/0211031 | A1 | 8/2012 | Loeffler | |
| 2013/0303725 | A1 | 11/2013 | Dobrawa | |
| 2013/0324453 | A1 | 12/2013 | Martinez-guzman | |
| 2013/0324456 | A1 | 12/2013 | Tantawy | |
| 2014/0000658 | A1 | 1/2014 | Koehneke | |
| 2014/0023609 | A1 | 1/2014 | Mukherjee | |
| 2014/0039051 | A1 | 2/2014 | Strodtholz et al. | |
| 2014/0045739 | A1* | 2/2014 | Baez Chavez | C11D 3/386 510/226 |
| 2014/0135247 | A1 | 5/2014 | Graf | |
| 2014/0179584 | A1* | 6/2014 | Catlin | B65B 9/04 510/220 |
| 2014/0186922 | A1 | 7/2014 | Estell | |
| 2014/0357541 | A1 | 12/2014 | Miracle | |
| 2015/0018264 | A1 | 1/2015 | Somerville | |
| 2015/0141312 | A1 | 5/2015 | Loeffler | |
| 2015/0336692 | A1 | 11/2015 | Brandt Sanz | |
| 2015/0337242 | A1 | 11/2015 | Graf | |
| 2016/0177229 | A1 | 6/2016 | Souter et al. | |
| 2017/0172145 | A1 | 6/2017 | Sherry | |
| 2017/0175035 | A1 | 6/2017 | Souter | |
| 2017/0175040 | A1 | 6/2017 | Souter et al. | |
| 2017/0175044 | A1 | 6/2017 | Souter et al. | |
| 2017/0175046 | A1 | 6/2017 | Souter et al. | |
| 2017/0175049 | A1 | 6/2017 | Souter et al. | |
| 2017/0175054 | A1 | 6/2017 | Souter et al. | |

FOREIGN PATENT DOCUMENTS

| | | | |
|---|---|---|---|
| EP | 0 634 476 | A1 | 1/1995 |
| EP | 1 072 673 | A2 | 1/2001 |
| GB | 2 317 390 | A | 3/1998 |
| WO | WO 93/04152 | A1 | 3/1993 |
| WO | WO 94/26862 | A1 | 11/1994 |
| WO | WO 95/12653 | A1 | 5/1995 |
| WO | WO 95/20030 | A1 | 7/1995 |
| WO | WO 00/34426 | A2 | 6/2000 |
| WO | WO 01/38479 | A1 | 5/2001 |
| WO | WO 01/66421 | A1 | 9/2001 |
| WO | WO 2012/153143 | A2 | 11/2012 |
| WO | WO 2013/092276 | A1 | 6/2013 |

OTHER PUBLICATIONS

U.S. Appl. No. 15/364,281, filed Nov. 30, 2016, Souter, et al.
U.S. Appl. No. 15/364,284, filed Nov. 30, 2016, Souter, et al.
U.S. Appl. No. 15/364,285, filed Nov. 30, 2016, Souter, et al.
U.S. Appl. No. 15/364,287, filed Nov. 30, 2016, Souter, et al.
U.S. Appl. No. 15/364,288, filed Nov. 30, 2016, Souter, et al.
International Search Report; International Application No. PCT/US2016/064046; dated Feb. 13, 2017; 13 pages.
Extended European Search Report; Application No. 15200970.0-1358; dated Mar. 6, 2016; 7 pages.
International Search Report; International Application No. PCT/US2016/064050; dated Feb. 17, 2017; 14 pages.
International Search Report; International Application No. PCT/US2016/064051; dated Feb. 3, 2017; 10 pages.
International Search Report; International Application No. PCT/US2016/064378; dated Feb. 16, 2017; 12 pages.
Extended European Search Report; Application No. 15200973.4-1375; dated Dec. 7, 2016; 10 pages.
International Search Report; International Application No. PCT/US2016/064383; dated Feb. 20, 2017; 13 pages.

* cited by examiner

AUTOMATIC DISHWASHING DETERGENT COMPOSITION

TECHNICAL FIELD

The present invention is in the field of automatic dishwashing. In particular it relates to a composition that is able to provide effective cleaning, shine and care.

BACKGROUND OF THE INVENTION

Typical automatic dishwashing products are formulated such that a 1% solution of the product has a pH of between 9 and 11.5. This is because in order to effectively clean the items found within the dishwasher and minimize the number of residues found in the machine filter, an automatic dishwashing product is formulated at high pH in order to effectively hydrate and swell soils, provide a pH range in which bleaches are effective (the hydroperoxide anion is a valuable bleaching species, either on its own or as a means to perhydrolyze a bleach activator such as TAED or charge a metal catalyst such as manganese methyltriazacyclononane, often known as Mn-TACN) and a pH in which triglyceride grease soils are effectively hydrolyzed.

At such high pHs, a significant quantity of insoluble calcium salts can be formed that lead to inorganic filming on items such as glasses, cutlery and plastic, particularly when the items are subjected to multi-cycles. This effect can be mitigated by use of strong soluble calcium builders such as MGDA and GLDA, although these represent an expensive solution to this problem.

The objective of the present invention is to provide an automatic dishwashing composition with provides good cleaning, shine and care.

SUMMARY OF THE INVENTION

According to a first aspect of the invention there is provided an automatic dishwashing composition that provides effective cleaning, shine and care.

The composition of the invention is neutral or acidic. By "neutral of acidic" is herein meant a composition having a pH of from about 5 to about 8.5, preferably from about 5.5 to about 7.5, more preferably from about 6 to about 7, as measured in 1% weight aqueous solution (distilled water) at 25° C. In addition to good cleaning and shine, this pH is quite gentle on the washed items. It is not as aggressive as commonly used alkaline compositions and therefore keeps washed items such as glasses, patterned ware, plastic, metal, etc looking new for longer.

The composition of the invention comprises a pH regulator system and a cleaning agent selected from the group consisting of cleaning surfactants, soil suspending polymers and mixtures thereof. It has surprisingly being found that the composition of the invention provides very good cleaning, care and shine. The composition comprises a relative high level of cleaning agent. As stated before traditional alkaline dishwashing compositions relay heavily on soil swelling for cleaning. The composition of the invention cleans by a different mechanism that does not relay on soil swelling. In the composition of the invention the cleaning agent plays a dominant role in the cleaning and unexpected good results are obtained with high levels of the cleaning agent. Cleaning agents such as surfactants, in particular non-ionic surfactants are usually part of automatic dishwashing composition to provide shine however in the compositions of the present invention the non-ionic surfactant plays a different role, it contributes to the removal and solubilisation on soils. Compositions comprising at least 15%, preferably at least 20% and less than 40% of cleaning agent have been found very good in terms of soil removal.

The cleaning agent is selected from the group consisting of cleaning surfactants, soil suspending polymers and mixtures thereof. Preferably, the cleaning surfactant is selected from the group consisting of anionic surfactants, amphoteric surfactants, non-ionic surfactants and mixtures thereof. Especially preferred for use herein are non-ionic surfactant, in particular a mixture of an alcohol ethoxylated and an epoxy-capped poly(oxyalkylated) alcohol.

Very good cleaning results have been found when the cleaning agent is a mixture of non-ionic surfactant and a soil suspending polymer, in particular a mixture of an alcohol ethoxylated and an epoxy-capped poly(oxyalkylated) alcohol non-ionic surfactant and an alkoxylated polyalkyleneimine.

The composition of the invention comprises from 0.01% to 5% by weight of the composition of a perfume, the perfume preferably comprises at least about 10%, more preferably at least about 20% and especially at least 30% by weight of the perfume of blooming perfume ingredients having a boiling point of less than 260° C. and a ClogP of at least 3.

Preferably, the composition of the invention comprises from 15% to 60%, preferably from 20 to 50% by weight of the composition of the pH regulator system.

The soils brought into the wash liquor during the automatic dishwashing process and the acid consumed in the effervescent system can greatly alter the pH of the wash liquor. In order to provide optimum cleaning the pH of the wash liquor should not vary too much. This is achieved with the composition of the present invention by the presence of a pH regulator system that helps to keep the pH of the wash liquor within a desired range.

By "pH regulator system" is herein meant an agent that when present in a wash liquor is capable of maintaining the pH of the liquor within a narrow range. By a "narrow range" is herein meant that the pH changes by less than 3 pH units, more preferably by less than 2 pH units and especially less than 1 pH unit.

Preferably the pH regulator system comprises an organic acid, preferably a carboxylic acid and more preferably the pH regulator system comprises a mixture of an acid and a conjugate, preferably a polycarboxylic acid and a salt thereof, more preferably citric acid and citrate.

Preferably, the composition of the invention comprises bleach, more preferably an inorganic bleach and especially sodium percarbonate Without wishing to be bound by theory, it is believed that in the composition of the invention is the combination of the bleach with the cleaning agent what provides the good performance on bleachable stains. The cleaning mechanism seems to be different from bleaching under alkaline conditions. Bleachable stains are removed by means of the cleaning agent in combination with the bleach, the cleaning agent seems to contribute to the break down and suspension of the soils and the bleach seems to work on the broken down soil.

It has surprisingly being found that the composition of the invention provides good removal of bleachable stains even in the absence of bleach catalyst. The composition is preferably free of bleach activator.

Preferably, the composition is phosphate free.

Preferably, the bleach is inorganic bleach, more preferably sodium percarbonate. Especially preferred is a composition in which the sodium percarbonate is in the form of a particle comprising a core substantially consisting of sodium percarbonate and a coating layer enclosing this core comprising preferably sodium sulphate, sodium carbonate, sodium borate, sodium silicate, sodium bicarbonate or mixtures thereof.

A preferred composition of the invention comprises:

a) from 15% to 55% by weight of the composition of a pH regulator system;

b) from 5% to 50% by weight of the composition of percarbonate;

c) from 15% to 25% by weight of the composition of a cleaning surfactant comprising a mixture of alcohol ethoxylated and epoxy-capped poly(oxyalkylated) alcohol non-ionic surfactants; and d) from 1% to 5% by weight of the composition of an alkoxylated polyalkyleneimine.

Preferably, the composition of the invention is "substantially builder-free". For the purpose of this invention a "substantially builder-free composition" is a composition comprising less than 10%, preferably less than 5%, more preferably less than 1% and especially less than 0.1% by weight of the composition of builder. Builders are cleaning actives widely used in automatic dishwashing detergents, in particular in alkaline compositions. Most, if not all, of the automatic dishwashing detergents available in the market are alkaline and comprise builders. Compounds that would act as builder under alkaline conditions would probably not be good builders under the low pH conditions of the composition of the invention. Builders can sequester calcium and other ions, from soils and from water greatly contributing to cleaning. The downside of using builders is that they can precipitate and give rise to filming and spotting on the washed items. The formulation approach used in the composition of the present invention ameliorates or overcomes the filming and spotting issues. The washed items, in particular, glass items are left clear and shiny.

Preferably, the composition of the invention comprises an iron chelant. Compositions comprising an iron chelant improve the cleaning of bleachable stains. Without being bound by theory, it is believed that the iron chelant removes heavy metals that form part of bleachable stains, thereby contributing to the loosening of the stain. The stain tends to detach itself from the soiled substrate. The cleaning is further helped by the presence of a cleaning agent comprising a non-ionic surfactant and a soil suspending polymer. Under the low pH conditions provided by the compositions of the invention, when the heavy metals are taken from the bleachable stain, the stain can become more particulate in nature and the polymer can help with suspension of the stain. Preferred iron chelants for use herein have been found to be disodium catecholdisulfonate and hydroxypyridine N-Oxides, in particular, hydroxypyridine N-Oxides.

Preferably, the composition of the invention comprises a cleaning enzyme, more preferably a cleaning enzyme in the form of a granulate. Especially preferred enzymes for the composition of the invention include an amylase, more preferably a low temperature amylase. It seems that the amylase and the cleaning agent work in synergy to provide very good cleaning and shine. Without being bound by theory it is believed that the cleaning agent helps to partially break the soils and it keeps the soil, especially greasy soils, suspended leaving the starchy part of soils exposed thereby facilitating the access of the amylase to the starch.

The cleaning provided by the compositions of the invention is further improved when the composition comprises a crystal growth inhibitor, in particular HEDP.

Preferred compositions further comprise proteases. In particular proteases selected from the group consisting of:

(i) a metalloprotease;

(ii) a cysteine protease;

(iii) a neutral serine protease;

(iv) an aspartate protease, and (v) mixtures thereof.

These proteases perform well in the low pH composition of the invention. Some of the proteases present in conventional alkaline detergents do not perform well at the pH of the composition of the invention. Also preferred are endoproteases, preferably those with an isoelectric point of from about 4 to about 9 and more preferably from about 4.5 to about 6.5. Compositions comprising proteases having these isoelectric points perform very well in the low pH compositions of the invention.

The compositions of the invention is so effective that only a low level needs to be used in the dishwasher to provide outstanding results thereby allowing for very compact compositions. The composition of the invention is preferably used in a weight per wash of from about 5 to about 25 grams, more preferably from about 7 to about 20 grams and especially from about 7 to about 15 grams.

The compositions of the invention are very suitable to be packed in unit-dose form. According to a second aspect of the invention, there is provided a single or multi-compartment water-soluble pouch comprising the composition of the invention. Preferably, the pouch comprises a compartment comprising a powder composition and a compartment comprising a liquid composition and wherein the liquid composition comprises the cleaning agent.

The elements of the composition of the invention described in connection with the first aspect of the invention apply *mutatis mutandis* to the second aspect of the invention.

DETAILED DESCRIPTION OF THE INVENTION

The present invention envisages a neutral or acidic automatic dishwashing detergent composition comprising a pH regulator system and a cleaning agent selected from the group consisting of cleaning surfactants, soil suspending polymers and mixtures thereof wherein the weight ratio of the pH regulator system to the cleaning agent is from 3:1 to 1:1. There is also provided a single or multi-compartment water-soluble pouch comprising the composition of the invention. The composition provides good cleaning, shine and care.

The composition of the invention has a neutral or acid pH. In addition to good cleaning and shine in automatic-dishwashing, this pH is quite gentle on the washed items, it is not as aggressive as commonly used alkaline compositions and therefore keeps washed items such as glasses, metal and plastic ware, patterned ware, etc looking new for longer.

The composition of the invention preferably comprises from 0.01% to 5% by weight of the composition of a perfume.

The composition of the invention can be in any physical form including solid, liquid and gel form. The composition of the invention is very well suited to be presented in unit-dose form, in particular in the form of a multi-compartment pack, more in particular a multi-compartment pack comprising compartments with compositions in different physical forms, for example a compartment comprising a composition in solid form comprising the pH regulator system and another compartment comprising a composition in liquid form comprising the cleaning agent or part thereof. Due to the efficacy of the composition, the packs can be compact.

Cleaning Agent

Preferably, the composition comprises from 2% to 15%, preferably from 4% to 10% by weight of the composition of cleaning agents selected from the group consisting of cleaning surfactants, soil suspending polymers and mixtures thereof. Especially preferred for use herein are mixtures of cleaning surfactants, in particular non-ionic surfactants, and a soil suspending polymer.

Preferably, the cleaning surfactant is selected from the group consisting of anionic surfactants, amphoteric surfactants, non-ionic surfactants and mixtures thereof.

Non-Ionic Surfactants

Suitable for use herein are non-ionic surfactants, they can help with the removal and solubilisation of soils. Traditionally, non-ionic surfactants have been used in automatic dishwashing for surface modification purposes in particular for sheeting to avoid filming and spotting and to improve shine. It has been found that in the compositions of the invention, where filming and spotting does not seem to be a problem, non-ionic surfactants can contribute to soil solubilisation and prevent redeposition of soils.

Preferably, the composition comprises a non-ionic surfactant or a non-ionic surfactant system having a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and better finishing properties and stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20, preferably 12 to 14 carbon atoms with from 5 to 12, preferably 6 to 10 moles of ethylene oxide per mole of alcohol or alkylphenol; and ii) alcohol alkoxylated surfactants having a from 6 to 20 carbon atoms and at least one ethoxy and propoxy group.

Another suitable non-ionic surfactants are epoxy-capped poly(oxyalkylated) alcohols represented by the formula:

$$R_1O[CH_2CH(CH_3)O]_x[CH_2CH_2O]_y[CH_2CH(OH)R_2] \quad (I)$$

wherein $R_1$ is a linear or branched, aliphatic hydrocarbon radical having from 4 to 18 carbon atoms; $R_2$ is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I has at least about 10 carbon atoms in the terminal epoxide unit $[CH_2CH(OH)R_2]$. Suitable surfactants of formula I are Olin Corporation's POLY-TERGENT® SLF-18B nonionic surfactants, as described, for example, in WO 94/22800, published Oct. 13, 1994 by Olin Corporation.

Preferably non-ionic surfactants and mixtures thereof to use as cleaning agents herein have a Draves wetting time of less than 360 seconds, preferably less than 200 seconds, more preferably less than 100 seconds and especially less than 60 seconds as measured by the Draves wetting method (standard method ISO 8022 using the following conditions; 3-g hook, 5-g cotton skein, 0.1% by weight aqueous solution at a temperature of 25° C.).

Amine oxides surfactants are also useful in the present invention as cleaning agents and include linear and branched compounds having the formula:

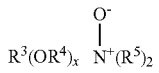

wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydroxyalkyl group containing from 1 to 3, preferably from 1 to 2 carbon atoms, or a polyethylene oxide group containing from 1 to 3, preferably 1, ethylene oxide groups. The $R^5$ groups can be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{18}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$-$C_{18}$ alkyl dimethylamine oxide, and $C_{10-18}$ acylamido alkyl dimethylamine oxide.

Non-ionic surfactants may be present in amounts from 1 to 10%, preferably from 0.1% to 10%, and most preferably from 0.25% to 6% by weight of the composition.

Anionic Surfactant

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C8-C 22 alkyl, or acyl group. Such surfactants are employed in the form of water-soluble salts and the salt-forming cation usually is selected from sodium, potassium, ammonium, magnesium and mono-, di- or tri-alkanolammonium, with the sodium cation being the usual one chosen.

The anionic surfactant can be a single surfactant or a mixture of anionic surfactants. Preferably the anionic surfactant comprises a sulphate surfactant, more preferably a sulphate surfactant selected from the group consisting of alkyl sulphate, alkyl alkoxy sulphate and mixtures thereof. Preferred alkyl alkoxy sulphates for use herein are alkyl ethoxy sulphates.

Alkyl Ether Sulphate (AES) Surfactants

The alkyl ether sulphate surfactant has the general formula (I)

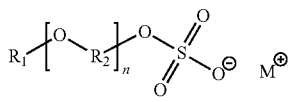

(I)

having an average alkoxylation degree (n) of from about 0.1 to about 8, 0.2 to about 5, even more preferably from about 0.3 to about 4, even more preferably from about 0.8 to about 3.5 and especially from about 1 to about 3.

The alkoxy group ($R_2$) could be selected from ethoxy, propoxy, butoxy or even higher alkoxy groups and mixtures thereof. Preferably, the alkoxy group is ethoxy. When the alkyl ether sulphate surfactant is a mixture of surfactants, the alkoxylation degree is the weight average alkoxylation degree of all the components of the mixture (weight average alkoxylation degree). In the weight average alkoxylation degree calculation the weight of alkyl ether sulphate surfactant components not having alkoxylated groups should also be included.

Weight average alkoxylation degree
$n$=($x1$*alkoxylation degree of surfactant 1+$x2$*alkoxylation degree of surfactant 2+ . . . )/($x1$+$x2$+ . . . )

wherein x1, x2, are the weights in grams of each alkyl ether sulphate surfactant of the mixture and alkoxylation degree is the number of alkoxy groups in each alkyl ether sulphate surfactant.

The hydrophobic alkyl group ($R_1$) can be linear or branched. Most suitably the alkyl ether sulphate surfactant to be used in the detergent of the present invention is a branched alkyl ether sulphate surfactant having a level of branching of from about 5% to about 40%, preferably from about 10% to about 35% and more preferably from about 20% to about 30%. Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the alkyl ether sulphate surfactant used in the detergent of the invention.

The branched alkyl ether sulphate surfactant can be a single sulphate surfactant or a mixture of sulphate surfactants. In the case of a single sulphate surfactant the percentage of branching refers to the weight percentage of the hydrocarbyl chains that are branched in the original alcohol from which the sulphate surfactant is derived.

In the case of a sulphate surfactant mixture the percentage of branching is the weight average and it is defined according to the following formula:

Weight average of branching (%)=[($x1$*$wt$ % branched alcohol 1 in alcohol 1+$x2$*$wt$ % branched alcohol 2 in alcohol 2+. . . )/($x1$+$x2$+. . . )]*100 wherein x1, x2, are the weight in grams of each alcohol in the total alcohol mixture of the alcohols which were used as starting material for the AES surfactant for the detergent of the invention. In the weight average branching degree calculation the weight of AES surfactant components not having branched groups should also be included.

Preferably the anionic surfactant of this invention is not purely based on a linear alcohol, but has some alcohol content that contains a degree of branching. Without wishing to be bound by theory it is believed that branched surfactant drives stronger starch cleaning, particularly when used in combination with an α-amylase, based on its surface packing.

Alkyl ether sulphates are commercially available with a variety of chain lengths, ethoxylation and branching degrees, examples are those based on Neodol alcohols ex the Shell company, Lial—Isalchem and Safol ex the Sasol company, natural alcohols ex The Procter & Gamble Chemicals Company.

Preferably, the alkyl ether sulfate is present from about 0.05% to about 20%, preferably from about 0.1% to about 8%, more preferably from about 1% to about 6%, and most preferably from about 2% to about 5% by weight of the composition.

Soil Suspending Polymer

Alkoxylated polyalkyleneimines are preferred soil suspending polymers for use herein. The composition of the composition preferably comprises from 1% to 10%, more preferably from 1% to 8% by weight of the composition of soil suspending polymer, in particular of a alkoxylated polyalkyleneimine.

The alkoxylated polyalkyleneimine has a polyalkyleneimine backbone and alkoxy chains. Preferably the polyalkyleneimine is polyethyleneimine. Preferably, the alkoxylated polyalkyleneimine is not quaternized.

In a preferred alkoxylated polyalkyleneimine for use in the composition of the invention:

i) the polyalkyleneimine backbone represents from 0.5% to 40%, preferably from 1% to 30% and especially from 2% to 20% by weight of the alkoxylated polyalkyleneimine; and ii) the alkoxy chains represent from 60% to 99%, preferably from 50% to about 95%, more preferably from 60% to 90% by weight of the alkoxylated polyalkyleneimine.

Preferably, the alkoxy chains have an average of from about 1 to about 50, more preferably from about 2 to about 40, more preferably from about 3 to about 30 and especially from about 3 to about 20 and even more especially from about 4 to about 15 alkoxy units preferably ethoxy units.

In other suitable polyalkyleneimine for use herein, the alkoxy chains have an average of from about 0 to 30, more preferably from about 1 to about 12, especially from about 1 to about 10 and even more especially from about 1 to about 8 propoxy units. Especially preferred are alkoxylated polyethyleneimines wherein the alkoxy chains comprise a combination of ethoxy and propoxy chains, in particular polyethyleneimines comprising chains of from 4 to 20 ethoxy units and from 0 to 6 propoxy units.

Preferably, the alkoxylated polyalkyleneimine is obtained from alkoxylation wherein the starting polyalkyleneimine has a weight-average molecular weight of from about 100 to about 60,000, preferably from about 200 to about 40,000, more preferably from about 300 to about 10,000 g/mol. A preferred example is 600 g/mol polyethyleneimine core ethoxylated to 20 EO groups per NH and is available from BASF.

Other suitable polyalkyleneimines for use herein includes compounds having the following general structure: bis((C2H5O)(C2H4O)n)(CH3)—N+–CxH2x—N+–(CH3)—bis((C2H5O)(C2H4O)n), wherein n=from 20 to 30, and x=from 3 to 8, or sulphated or sulphonated variants thereof.

pH Regulator System

The benefits provided by the composition of the invention are linked to the low pH of the wash liquor. It is not sufficient to provide a composition presenting a low pH when dissolved in deionised water, what is important is that the low pH of the composition is maintained during the duration of the wash.

In the process of dishwashing, the water and the different ions coming from the soils can destabilise the pH of the composition. In order to maintain the composition at low pH a pH regulator system capable of maintaining the low pH during the wash is needed. A pH regulating systems can be created either by using a mixture of an acid and its anion, such as a citrate salt and citric acid, or by using a mixture of the acid form (citric acid) with a source of alkalinity (such as a hydroxide, bicarbonate or carbonate salt) or by using the anion (sodium citrate) with a source of acidity (such as sodium bisulphate). Suitable pH regulating systems comprise mixtures of organic acids and their salts, such as citric acid and citrate.

Preferred pH regulator systems for use herein include a polycarboxylic acid, its salts and mixtures thereof, preferably citric acid, citrate and mixtures thereof.

Preferably the composition of the invention comprises from about 15% to about 60%, more preferably from about 20% to about 55% by weight of the composition of a pH regulator system, preferably selected from citric acid, citrate and mixtures thereof.

Bleach

The composition of the invention preferably comprises from 10% to 50%, more preferably from 15% to 40% of bleach by weight of the composition.

Inorganic bleaches include perhydrate salts such as perborate, percarbonate, perphosphate, persulfate and persilicate salts. Sodium percarbonate is the preferred bleach for use herein. The percarbonate is most preferably incorporated into the composition of the invention in a coated form which provides in-product stability. The preferred percarbonate particles used herein comprise a core substantially consisting of bleach, preferably sodium percarbonate, and a coating layer enclosing this core comprising preferably sodium sulphate, sodium carbonate, sodium borate, sodium silicate, sodium bicarbonate or mixtures thereof. The core can be produced by crystallisation or preferably fluidised bed spray granulation and the coating layer can be obtainable by spraying an aqueous inorganic salt, preferably sodium sulphate solution onto the uncoated particles of bleach. The fluidised bed temperature is from 35 to 100° C. to allow for water evaporation. In the case in which the coating material is sodium sulphate, the fluidised bed temperature during application of the coating layer is maintained above the transition temperature of the decahydrate (32.4° C.).

The coating layer is preferably from 1 to 50% by weight of the particle, preferably from 2-20%, most preferably from 3-10%.

The bleach can be coated using a plurality of processes, for example by coating in a fluidised bed. Details of the process are found at EP 862 842 A1 and U.S. Pat. No. 6,113,805.

Builder

Preferably, the composition of the invention is substantially builder free, i.e. comprises less than about 10%, preferably less than about 5%, more preferably less than about 1% and especially less than about 0.1% of builder by weight of the composition. Builders are materials that sequester hardness ions, particularly calcium and/or magnesium. Strong calcium builders are species that are particularly effective at binding calcium and exhibit strong calcium binding constants, particularly at high pHs.

For the purposes of this patent a "builder" is a strong calcium builder. A strong calcium builder can consist of a builder that when present at 0.5 mM in a solution containing 0.05 mM of Fe(III) and 2.5 mM of Ca(II) will selectively bind the calcium ahead of the iron at one or more of pHs 6.5 or 8 or 10.5. Specifically, the builder when present at 0.5 mM in a solution containing 0.05 mM of Fe(III) and 2.5 mM of Ca(II) will bind less than 50%, preferably less than 25%, more preferably less than 15%, more preferably less than 10%, more preferably less than 5%, more preferably less than 2% and specially less than 1% of the Fe(III) at one or preferably more of pHs 6.5 or 8 as measured at 25° C. The builder will also preferably bind at least 0.25 mM of the calcium, preferably at least 0.3 mM, preferably at least 0.4 mM, preferably at least 0.45 mM, preferably at least 0.49 mM of calcium at one or more of pHs 6.5 or 8 or 10.5 as measured at 25° C.

The most preferred strong calcium builders are those that will bind calcium with a molar ratio (builder:calcium) of less than 2.5:1, preferably less than 2:1, preferably less than 1.5:1 and most preferably as close as possible to 1:1, when equal quantities of calcium and builder are mixed at a concentration of 0.5 mM at one or more of pHs 6.5 or 8 or 10.5 as measured at 25° C.

Examples of strong calcium builders include phosphate salts such as sodium tripolyphosphate, amino acid-based builders such as amino acid based compounds, in particular MGDA (methyl-glycine-diacetic acid), and salts and derivatives thereof, GLDA (glutamic-N,N-diacetic acid) and salts and derivatives thereof, IDS (iminodisuccinic acid) and salts and derivatives thereof, carboxy methyl inulin and salts and derivatives thereof and mixtures thereof.

Other builders include amino acid based compound or a succinate based compound. Other suitable builders are described in U.S. Pat. No. 6,426,229. In one aspect, suitable builders include, for example, aspartic acid-N-monoacetic acid (ASMA), aspartic acid-, -diacetic acid (ASDA), aspartic acid-N-monopropionic acid (ASMP), iminodisuccinic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MID A), alpha-alanine-N,N-diacetic acid (alpha-ALDA), serine-, -diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N, N-diacetic acid (SLDA), taurine-N,N-diacetic acid (TUDA) and sulfomethyl-N,N-diacetic acid (SMDA) and alkali metal salts or ammonium salts thereof.

Polycarboxylic acids and their salts do not act as builders at the pH of the present invention and therefore are not to be considered as builders within the meaning of the invention.

Polycarboxylic acids and their salts are considered a buffer within the meaning of the invention.

Iron Chelant

The composition of the invention preferably comprises an iron chelant at a level of from about 0.1% to about 5%, preferably from about 0.2% to about 2%, more preferably from about 0.4% to about 1% by weight of the composition.

As commonly understood in the detergent field, chelation herein means the binding or complexation of a bi- or multi-dentate ligand. These ligands, which are often organic compounds, are called chelants, chelators, chelating agents, and/or sequestering agent. Chelating agents form multiple bonds with a single metal ion. Chelants form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant.

The composition of the present invention is preferably substantially free of builders and preferably comprises an iron chelant. An iron chelant has a strong affinity (and high binding constant) for Fe(III).

It is to be understood that chelants are to be distinguished from builders. For example, chelants are exclusively organic and can bind to metals through their N,P,O coordination sites or mixtures thereof while builders can be organic or inorganic and, when organic, generally bind to metals through their O coordination sites. Moreover, the chelants typically bind to transition metals much more strongly than to calcium and magnesium; that is to say, the ratio of their transition metal binding constants to their calcium/magnesium binding constants is very high. By contrast, builders herein exhibit much less selectivity for transition metal binding, the above-defined ratio being generally lower.

The chelant in the composition of the invention is a selective strong iron chelant that will preferentially bind with iron (III) versus calcium in a typical wash environment where calcium will be present in excess versus the iron, by a ratio of at least 10:1, preferably greater than 20:1. The iron chelant when present at 0.5 mM in a solution containing 0.05 mM of Fe(III) and 2.5 mM of Ca(II) will fully bind at least 50%, preferably at least 75%, more preferably at least 85%,more preferably at least 90%, more preferably at least 95%, more preferably at least 98% and specially at least 99% of the Fe(III) at one or preferably more of pHs 6.5 or 8 as measured at 25° C. The amount of Fe(III) and Ca(II) bound by a builder or chelant is determined as explained herein below Method for Determining Competitive Binding To determine the selective binding of a specific ligand to specific metal ions, such as iron(III) and calcium (II), the binding constants of the metal ion-ligand complex are obtained via reference tables if available, otherwise they are determined experimentally. A speciation modeling simulation can then be performed to quantitatively determine what metal ion-ligand complex will result under a specific set of conditions.

As used herein, the term "binding constant" is a measurement of the equilibrium state of binding, such as binding between a metal ion and a ligand to form a complex. The binding constant $K_{bc}$ (25° C. and an ionic strength (I) of 0.1 mol/L) is calculated using the following equation:

$$K_{bc=[MLx]}/([M][L]^x)$$

where [L] is the concentration of ligand in mol/L, x is the number of ligands that bond to the metal, [M] is the concentration of metal ion in mol/L, and $[ML_x]$ is the concentration of the metal/ligand complex in mol/L.

Specific values of binding constants are obtained from the public database of the National Institute of Standards and Technology ("NIST"), R. M. Smith, and A. E. Martell, NIST Standard Reference Database 46, NIST Critically Selected Stability Constants of Metal Complexes: Version 8.0, May 2004, U.S. Department of Commerce, Technology Administration, NIST, Standard Reference Data Program, Gaithersburg, Md. If the binding constants for a specific ligand are not available in the database then they are measured experimentally.

Once the appropriate binding constants have been obtained, a speciation modeling simulation can be performed to quantitatively determine what metal ion-ligand complex will result under a specific set of conditions including ligand concentrations, metal ion concentrations, pH, temperature and ionic strength. For simulation purposes, NIST values at 25° C. and an ionic strength (I) of 0.1 mol/L with sodium as the background electrolyte are used. If no value is listed in NIST the value is measured experimentally. PHREEQC from the US Geological Survey, http://wwwbr-r.cr.usgs.gov/projects/GWC_coupled/phreeqc/. PHREEQC is used for speciation modeling simulation.

Iron chelants include those selected from siderophores, catechols, enterobactin, hydroxamates and hydroxypyridinones or hydroxypyridine N-Oxides. Preferred chelants include anionic catechols, particularly catechol sulphonates, hydroxamates and hydroxypyridine N-Oxides. Preferred strong chelants include hydroxypridine N-Oxide (HPNO), Octopirox, and/or Tiron (disodium 4,5-dihydroxy-1,3-benzenedisulfonate), with Tiron, HPNO and mixtures thereof as the most preferred for use in the composition of the invention. HPNO within the context of this invention can be substituted or unsubstituted. Numerous potential and actual resonance structures and tautomers can exist. It is to be understood that a particular structure includes all of the reasonable resonance structures and tautomers.

Crystal Growth Inhibitor

Crystal growth inhibitors are materials that can bind to calcium carbonate crystals and prevent further growth of species such as aragonite and calcite.

Examples of effective crystal growth inhibitors include phosphonates, polyphosphonates, inulin derivatives and cyclic polycarboxylates.

Suitable crystal growth inhibitors may be selected from the group comprising HEDP (1-hydroxyethylidene 1,1-diphosphonic acid), carboxymethylinulin (CMI), tricarballylic acid and cyclic carboxylates. For the purposes of this invention the term carboxylate covers both the anionic form and the protonated carboxylic acid form.

Cyclic carboxylates contain at least two, preferably three or preferably at least four carboxylate groups and the cyclic structure is based on either a mono- or bi-cyclic alkane or a heterocycle. Suitable cyclic structures include cyclopropane, cyclobutane, cyclohexane or cyclopentane or cycloheptane, bicyclo-heptane or bicyclo-octane and/or tetrahydrofuran. One preferred crystal growth inhibitor is cyclopentane tetracarboxylate.

Cyclic carboxylates having at least 75%, preferably 100% of the carboxylate groups on the same side, or in the "cis" position of the 3D-structure of the cycle are preferred for use herein.

It is preferred that the two carboxylate groups, which are on the same side of the cycle are in directly neighbouring or "ortho" positions Preferred crystal growth inhibitors include HEDP, tricarballylic acid, tetrahydrofurantetracarboxylic acid (THFTCA) and cyclopentanetetracarboxylic acid (CPTCA). The THFTCA is preferably in the 2c,3t,4t,5c-configuration, and the CPTCA in the cis,cis,cis,cis-configuration.

The crystal growth inhibitors are present preferably in a quantity from about 0.01 to about 10%, particularly from about 0.02 to about 5% and in particular from 0.05 to 3% by weight of the composition.

Suds Suppressors

Suds suppressors are preferably included in the composition of the invention, especially when the composition comprises anionic surfactant. The suds suppressor is included in the composition at a level of from about 0.0001% to about 10%, preferably from about 0.001% to about 5%, more preferably from about 0.01% to about 1.5% and especially from about 0.01% to about 0.5%, by weight of the composition.

Preferably the composition of the invention comprises enzymes, more preferably amylases and proteases. The enzymes are preferably in the form of a granulate.

Enzyme Particles

Suitable enzyme granulates for use herein include those formed according to any of the below technologies:

a) Spray dried products, wherein a liquid enzyme-containing solution is atomised in a spray drying tower to form small droplets which during their way down the drying tower dry to form an enzyme-containing particulate material. Very small particles can be produced this way (Michael S. Showell (editor); Powdered detergents; Surfactant Science Series; 1998; vol. 71; page 140-142; Marcel Dekker).

b) Layered products, wherein the enzyme is coated as a layer around a pre-formed inert core particle, wherein an enzyme-containing solution is atomised, typically in a fluid bed apparatus wherein the pre-formed core particles are fluidised, and the enzyme-containing solution adheres to the core particles and dries up to leave a layer of dry enzyme on the surface of the core particle. Particles of a desired size can be obtained this way if a useful core particle of the desired size can be found. This type of product is described in e.g. WO 97/23606 c) Absorbed core particles, wherein rather than coating the enzyme as a layer around the core, the enzyme is absorbed onto and/or into the surface of the core. Such a process is described in WO 97/39116.

d) Extrusion or pelletized products, wherein an enzyme-containing paste is pressed to pellets or under pressure is extruded through a small opening and cut into particles which are subsequently dried. Such particles usually have a considerable size because of the material in which the extrusion opening is made (usually a plate with bore holes) sets a limit on the allowable pressure drop over the extrusion opening. Also, very high extrusion pressures when using a small opening increase heat generation in the enzyme paste, which is harmful to the enzyme. (Michael S. Showell (editor); Powdered detergents; Surfactant Science Series; 1998; vol. 71; page 140-142; Marcel Dekker)

e) Prilled products or, wherein an enzyme powder is suspended in molten wax and the suspension is sprayed, e.g. through a rotating disk atomiser, into a cooling chamber where the droplets quickly solidify (Michael S. Showell (editor); Powdered detergents; Surfactant Science Series; 1998; vol. 71; page 140-142; Marcel Dekker). The product obtained is one wherein the enzyme is uniformly distributed throughout an inert material instead of being concentrated on its surface. Also U.S. Pat. Nos. 4,016,040 and 4,713,245 are documents relating to this technique f) Mixer granulation products, wherein an enzyme-containing liquid is added to a dry powder composition of conventional granulating components. The liquid and the powder in a suitable proportion are mixed and as the moisture of the liquid is absorbed in the dry powder, the components of the dry powder will start to adhere and agglomerate and particles will build up, forming granulates comprising the enzyme. Such a process is described in U.S. Pat. No. 4,106,991 (NOVO NORDISK) and related documents EP 170360 B1, EP 304332 B1, EP 304331, WO 90/09440 and WO 90/09428. In a particular product of this process wherein various high-shear mixers can be used as granulators, granulates consisting of the enzyme, fillers and binders etc. are mixed with cellulose fibres to reinforce the particles to give the so-called T-granulate. Reinforced particles, being more robust, release less enzymatic dust.

Preferably, the enzyme granulates, for use in the composition of the invention, have a core-shell structure. In preferred core-shell embodiments the core comprises a central part, preferably free of enzymes, and a surrounding layer containing enzymes and the shell comprises a plurality of layers, the most outer layer being a protective layer. In preferred embodiments the central part of the core and at least one of the layers of the shell comprise an inert protective material, said inert protective material preferably comprising carbohydrates such as sugars, low molecular weight proteins, sodium sulphate and mixtures thereof. Preferably the central part of the core represents from 1% to 60%, more preferably from 3% to 50% and especially from 5% to 40% by weight of the total particle. Preferably the layer comprising the efflorescent material represents from 0.5% to 40%, more preferably from 1% to 30% and especially from 3% to 20% by weight of the total particle. Preferably the most outer layer comprises polyvinyl alcohol, more preferably titanium oxide (for aesthetic reasons) and especially a combination thereof. Preferably the protective layer represents from 0.05% to 20%, more preferably from 0.1% to 15% and especially from 1% to 3% by weight of the total particle. The enzyme granulate can also contain adjunct materials such as antioxidants, dyes, activators, solubilizers, binders, etc. Enzymes according to this embodiment can be made by a fluid bed layering process similar to that described in U.S. Pat. Nos. 5,324,649, 6,602,841 B1 and US2008/0206830A1.

Enzymes according to this embodiment can also be made by a combination of processes. Such enzyme granulates are built around a core that can be free of enzymes or contain enzymes (preferably comprising an inert protective material, more preferably sodium sulphate) that can be made using a variety of processes including use of either a mixer granulator or an extruder or a fluid bed process. In the mixer granulator process, preferably the enzyme particle is coated with a polymer such as polyethylene glycols, hydroxpropylmethylcellulose and/or polyvinylalcohol and derivatives thereof. Preferably the coating comprises a polyethylene glycol polymer, a clay such as kaolin and a whitening agent selected from the group comprising calcium carbonate and titanium dioxide.

In a fluid bed process the enzyme can be sprayed onto the core and the core is then coated by a layer, preferably comprising an inert protective material, preferably comprising some sodium sulphate, and finally is coated with a polymer selected from the group comprising polyethylene glycols, hydroxpropylmethylcellulose and/or polyvinylalcohol and derivatives thereof, optionally also containing additional titanium dioxide and/or calcium carbonate or any mixtures thereof.

Processes suitable for making the enzyme granulate for use herein are described in U.S. Pat. No. 6,348,442 B2, US 2004/0033927 A1, U.S. Pat. No. 7,273,736, WO 00/01793, U.S. Pat. No. 6,268,329 B1 and US2008/0206830A1. Preferably, the granulate comprises from about 30% to about 75%, preferably from about 40 to about 50% by weight of the granulate of an inert protective material, selected from the group comprising sodium sulphate, sodium citrate and mixtures thereof, preferably sodium sulphate.

Preferably, the enzyme granulates have a weight geometric mean particle size of from about 200 μm to about 1200 μm, more preferably from about 300 μm to about 1000 μm and especially from about 400 μm to about 600 μm.

Enzyme-Related Terminology

Nomenclature for Amino Acid Modifications

In describing enzyme variants herein, the following nomenclature is used for ease of reference:

Original amino acid(s):position(s):substituted amino acid(s).

According to this nomenclature, for instance the substitution of glutamic acid for glycine in position 195 is shown as G195E. A deletion of glycine in the same position is shown as G195*, and insertion of an additional amino acid residue such as lysine is shown as G195GK. Where a specific enzyme contains a "deletion" in comparison with other enzyme and an insertion is made in such a position this is indicated as *36D for insertion of an aspartic acid in position 36. Multiple mutations are separated by pluses, i.e.: S99G+V102N, representing mutations in positions 99 and 102 substituting serine and valine for glycine and asparagine, respectively. Where the amino acid in a position (e.g. 102) may be substituted by another amino acid selected from a group of amino acids, e.g. the group consisting of N and I, this will be indicated by V102N/I.

In all cases, the accepted IUPAC single letter or triple letter amino acid abbreviation is employed.

Where multiple mutations are employed they are shown with either using a "+" or a "/", so for instance either S126C+P127R+S128D or S126C/P127R/S128D would indicate the specific mutations shown are present in each of positions 126, 127 and 128.

Amino Acid Identity

The relatedness between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

The degree of identity between an amino acid sequence of an enzyme used herein ("invention sequence") and a different amino acid sequence ("foreign sequence") is calculated as the number of exact matches in an alignment of the two sequences, divided by the length of the "invention sequence" or the length of the "foreign sequence", whichever is the shortest. The result is expressed in percent identity. An exact match occurs when the "invention sequence" and the "foreign sequence" have identical amino acid residues in the same positions of the overlap. The length of a sequence is the number of amino acid residues in the sequence.

Protease

Preferred proteases for use herein have an isoelectric point of from about 4 to about 9, preferably from about 4 to about 8, most preferably from about 4.5 to about 6.5. Proteases with this isoelectric point present good activity in the wash liquor provided by the composition of the invention. As used herein, the term "isoelectric point" refers to electrochemical properties of an enzyme such that the enzyme has a net charge of zero as calculated by the method described below.

Preferably the protease of the composition of the invention is an endoprotease, by "endoprotease" is herein understood a protease that breaks peptide bonds of non-terminal amino acids, in contrast with exoproteases that break peptide bonds from their end-pieces.

Isoelectric Point

The isoelectric point (referred to as IEP or pI) of an enzyme as used herein refers to the theoretical isoelectric point as measured according to the online pI tool available from ExPASy server at the following web address:

http://web.expasy.org/compute_pi/

The method used on this site is described in the below reference: Gasteiger E., Hoogland C., Gattiker A., Duvaud S., Wilkins M. R., Appel R. D., Bairoch A.;

Protein Identification and Analysis Tools on the ExPASy Server;

(In) John M. Walker (ed): The Proteomics Protocols Handbook, Humana Press (2005).

Preferred proteases for use herein are selected from the group consisting of a metalloprotease, a cysteine protease, a neutral serine protease, an aspartate protease and mixtures thereof.

Metalloproteases

Metalloproteases can be derived from animals, plants, bacteria or fungi. Suitable metalloprotease can be selected from the group of neutral metalloproteases and *Myxobacter* metalloproteases. Suitable metalloproteases can include collagenases, hemorrhagic toxins from snake venoms and thermolysin from bacteria. Preferred thermolysin enzyme variants include an M4 peptidase, more preferably the thermolysin enzyme variant is a member of the PepSY~Peptidase_M4~Peptidase_M4_C family.

Preferred metalloproteases include thermolysin, matrix metalloproteinases and those metalloproteases derived from *Bacillus subtilis, Bacillus thermoproteolyticus, Geobacillus stearothermophilus* or *Geobacillus* sp., or *Bacillus amyloliquefaciens*, as described in U.S. PA 2008/0293610A1. A specially preferred metalloprotease belongs to the family EC3.4.24.27.

Further suitable metalloproteases are the thermolysin variants described in WO2014/71410. In one aspect the metalloprotease is a variant of a parent protease, said parent protease having at least 50% or 60%, or 80%, or 85% or 90% or 95% or 96% or 97% or 98% or 99% or even 100% identity to SEQ ID NO: 3 of WO 2014/071410 including those with substitutions at one or more of the following sets of positions versus SEQ ID NO: 3 of WO 2014/071410:

(a) 2, 26, 47, 53, 87, 91,96, 108, 118, 154, 179, 197, 198, 199, 209, 211, 217, 219, 225, 232, 256, 257, 259, 261, 265, 267, 272,276, 277, 286, 289, 290, 293, 295, 298, 299, 300, 301, 303, 305, 308, 311 and 316;

(b) 1, 4, 17, 25, 40, 45, 56, 58, 61, 74, 86, 97, 101, 109, 149, 150, 158, 159, 172, 181, 214, 216, 218, 221, 222, 224, 250, 253, 254, 258, 263, 264, 266, 268, 271, 273, 275, 278, 279, 280, 282, 283, 287, 288, 291, 297, 302, 304, 307 and 312;

(c) 5, 9, 11, 19, 27, 31, 33, 37, 46, 64, 73, 76, 79, 80, 85, 89, 95, 98, 99, 107, 127, 129, 131, 137, 141, 145, 148, 151, 152, 155, 156, 160, 161, 164, 168, 171, 176, 180, 182, 187, 188, 205, 206, 207, 210, 212, 213, 220, 227, 234, 235, 236, 237, 242, 244, 246, 248, 249, 252, 255, 270, 274, 284, 294, 296, 306, 309, 310, 313, 314 and 315;

(d) 3, 6, 7, 20, 23, 24, 44, 48, 50, 57, 63, 72, 75, 81, 92, 93, 94, 100, 102, 103, 104, 110, 117, 120, 134, 135, 136, 140, 144, 153, 173, 174, 175, 178, 183, 185, 189, 193, 201, 223, 230, 238, 239, 241, 247, 251, 260, 262, 269, and 285;

(e) 17, 19, 24, 25, 31, 33, 40, 48, 73, 79, 80, 81, 85, 86, 89, 94, 109, 117, 140, 141, 150, 152, 153, 158, 159, 160, 161, 168, 171, 174, 175, 176, 178, 180, 181, 182, 183, 189, 205, 206, 207, 210, 212, 213, 214, 218, 223, 224,227, 235, 236, 237, 238, 239, 241, 244, 246, 248, 249, 250, 251, 252, 253, 254, 255, 258, 259, 260, 261, 262, 266, 268, 269, 270, 271, 272, 273, 274, 276, 278, 279, 280, 282, 283, 294, 295, 296, 297, 300, 302, 306, 310 and 312;

(f) 1, 2, 127, 128, 180, 181, 195, 196, 197, 198, 199, 211, 223, 224, 298, 299, 300, and 316 all relative to SEQ ID NO: 3 of WO 2014/071410.

Further suitable metalloproteases are the NprE variants described in WO2007/044993, WO2009/058661 and US 2014/0315775. In one aspect the protease is a variant of a parent protease, said parent protease having at least 45%, or 60%, or 80%, or 85% or 90% or 95% or 96% or 97% or 98% or 99% or even 100% identity to SEQ ID NO:3 of US 2014/0315775 including those with substitutions at one or more of the following sets of positions versus said sequence:

S23, Q45, T59, S66, S129, F130, M138, V190, S199, D220, K211, and G222,

Another suitable metalloprotease is a variant of a parent protease, said parent protease having at least 60%, or 80%, or 85% or 90% or 95% or 96% or 97% or 98% or 99% or even 100% identity to SEQ ID NO:3 of US 2014/0315775 including those with substitutions at one or more of the following sets of positions versus SEQ ID NO:3 of US 2014/0315775:

Q45E, T59P, 566E, S129I, S129V, F130L, M138I, V190I, S199E, D220P, D220E, K211V, K214Q, G222C, M138L/D220P, F130L/D220P, S129I/D220P, V190I/D220P, M138L/V190I/D220P, S129I/V190I, S129V/V190I, S129V/D220P, S129I/F130L/D220P, T004V/S023N, T059K/S66Q/S129I, T059R/S66N/S129I, S129I/F130L/M138L/V190I/D220P and T059K/S66Q/S129V.

Especially preferred metalloproteases for use herein belong belong to EC classes EC 3.4.22 or EC3.4.24, more preferably they belong to EC classes EC3.4.22.2, EC3.4.24.28 or EC3.4.24.27. The most preferred metalloprotease for use herein belong to EC3.4.24.27.

Suitable commercially available metalloprotease enzymes include those sold under the trade names Neutrase® by Novozymes A/S (Denmark), the Corolase® range including Corolase® 2TS, Corolase® N, Corolase® L10, Corolase® LAP and Corolase® 7089 from AB Enzymes, Protex 14L and Protex 15L from DuPont (Palo Alto, Calif.), those sold as thermolysin from Sigma and the Thermoase range (PC10F and C100) and thermolysin enzyme from Amano enzymes.

The composition of the invention preferably comprises from 0.001 to 2%, more preferably from 0.003 to 1%, more preferably from 0.007 to 0.3% and especially from 0.01 to 0.1% by weight of the composition of active protease.

Amylase

Amylases for use herein are preferably low temperature amylases. Compositions comprising low temperature amylases allow for a more energy efficient dishwashing processes without compromising in cleaning.

As used herein, "low temperature amylase" is an amylase that demonstrates at least 1.2, preferably at least 1.5 and more preferably at least 2 times the relative activity of the reference amylase at 25° C. As used herein, the "reference amylase" is the wild-type amylase of *Bacillus licheniformis*, commercially available under the tradename of Termamyl™ (Novozymes A/S). As used herein, "relative activity" is the fraction derived from dividing the activity of the enzyme at the temperature assayed versus its activity at its optimal temperature measured at a pH of 9. Amylases include, for example, α-amylases obtained from Bacillus. Amylases of this invention preferably display some α-amylase activity. Preferably said amylases belong to EC Class 3.2.1.1. Amylases for use herein, including chemically or genetically modified mutants (variants), are amylases possessing at least 60%, or 70%, or 80%, or 85%, or 90%, preferably 95%, more preferably 98%, even more preferably 99% and especially 100% identity, with those derived from *Bacillus Licheniformis, Bacillus amyloliquefaciens, Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP1, 022,334). Suitable amylases include those derived from the sp. 707, sp. 722 or AA560 parent wild-types.

Preferred amylases include the variants of a parent amylase, said parent amylase having at least 60%, preferably 80%, more preferably 85%, more preferably 90%, more preferably 95%, more preferably 96%, more preferably 97%, more preferably 98%, more preferably 99% and specially 100% identity to SEQ ID NO:12 of WO2006/002643. The variant amylase preferably further comprises one or more substitutions and/or deletions in the following positions versus SEQ ID NO:12 of WO2006/002643:

9, 26, 30, 33, 82, 37, 106, 118, 128, 133, 149, 150, 160, 178, 182, 186, 193, 195, 202, 203, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484 and preferably the variant amylase comprises the deletions in one or both of the 183 and 184 positions.

Preferred amylases comprise one or both deletions in positions equivalent to positions 183 and 184 of SEQ ID NO:12 of WO2006/002643.

Preferred commercially available amylases for use herein are STAINZYME®, STAINZYME PLUS®, STAINZYME ULTRA®, EVEREST® and NATALASE® (Novozymes A/S) and RAPIDASE, POWERASE® and the PREFERENZ S® series, including PREFERENZ S100® (DuPont).

The composition of the invention preferably comprises from 0.001 to 2%, more preferably from 0.003 to 1%, more preferably from 0.007 to 0.3% and especially from 0.01 to 0.1% by weight of the composition of active amylase.

Other Enzymes

Preferably the composition of the invention further comprises one or more enzymes selected from the group consisting of an α-amylase, a β-amylase, a pullulanase, a protease, a lipase, a cellulase, an oxidase, a phospholipase, a perhydrolase, a xylanase, a pectate lyase, a pectinase, a galacturanase, a hemicellulase, a xyloglucanase, a mannanase and a mixture thereof.

Unit Dose Form

The composition of the invention is suitable to be presented in unit-dose form. Products in unit dose form include tablets, capsules, sachets, pouches, injection moulded containers, etc. Preferred for use herein are tablets and detergents wrapped with a water-soluble film (including wrapped tablets, capsules, sachets, pouches) and injection moulded containers. Preferably the water-soluble film is a polyvinyl alcohol, preferably comprising a bittering agent. The detergent composition of the invention is preferably in the form of a water-soluble multi-compartment pack.

Preferred packs comprise at least two side-by-side compartments superposed onto another compartment. This disposition contributes to the compactness, robustness and strength of the pack and additionally, it minimises the amount of water-soluble packing material required. It only requires three pieces of material to form three compartments. The robustness of the pack allows also for the use of very thin films (less than 150 micron, preferably less than 100 micron) without compromising the physical integrity of the pack. The pack is also very easy to use because the compartments do not need to be folded to be used in machine dispensers of fixed geometry. At least two of the compartments of the pack contain two different compositions. By "different compositions" herein is meant compositions that differ in at least one ingredient.

Preferably, at least one of the compartments contains a solid composition, preferably in powder form and another compartment an aqueous liquid composition, the compositions are preferably in a solid to liquid weight ratio of from about 20:1 to about 1:20, more preferably from about 18:1 to about 2:1 and even more preferably from about 15:1 to about 5:1. This kind of pack is very versatile because it can accommodate compositions having a broad spectrum of values of solid:liquid ratio. Particularly preferred have been found to be pouches having a high solid:liquid ratio because many of the detergent ingredients are most suitable for use in solid form, preferably in powder form. The ratio solid: liquid defined herein refers to the relationship between the weight of all the solid compositions and the weight of all the liquid compositions in the pack.

Preferably the two side-by-side compartments contain liquid compositions, which can be the same but preferably are different and another compartment contains a solid composition, preferably in powder form, more preferably a densified powder. The solid composition contributes to the strength and robustness of the pack.

For dispenser fit reasons the unit dose form products herein preferably have a square or rectangular base and a height of from about 1 to about 5 cm, more preferably from about 1 to about 4 cm. Preferably the weight of the solid composition is from about 5 to about 20 grams, more preferably from about 10 to about 15 grams and the total weight of the liquid compositions is from about 0.5 to about 5 grams, more preferably from about 1.5 to about 4 grams.

In preferred embodiments, at least two of the films which form different compartments have different solubility, under the same conditions, releasing the content of the compositions which they partially or totally envelope at different times.

Controlled release of the ingredients of a multi-compartment pouch can be achieved by modifying the thickness of the film and/or the solubility of the film material. The solubility of the film material can be delayed by for example cross-linking the film as described in WO 02/102,955 at pages 17 and 18. Other water-soluble films designed for rinse release are described in U.S. Pat. Nos. 4,765,916 and 4,972,017. Waxy coating (see WO 95/29982) of films can help with rinse release. pH controlled release means are described in WO 04/111178, in particular amino-acetylated polysaccharide having selective degree of acetylation.

Other means of obtaining delayed release by multi-compartment pouches with different compartments, where the compartments are made of films having different solubility are taught in WO 02/08380.

Alternatively the dissolution of the liquid compartments can be delayed by modification of the liquid that is contained within the film. Use of anionic surfactants, particularly anionic surfactant mixtures that pass through a highly structured phase (such as hexagonal or lamellar) upon addition of water retards the dissolution of the surfactant containing compartment. In one aspect of this invention, one or more compartments comprise anionic surfactant and their release is delayed versus other compartments.

Auto-Dosing Delivery Device

The compositions of the invention are extremely useful for dosing elements to be used in an auto-dosing device. The dosing elements comprising the composition of the present invention can be placed into a delivery cartridge as that described in WO 2007/052004 and WO 2007/0833141. The dosing elements can have an elongated shape and set into an array forming a delivery cartridge which is the refill for an auto-dosing dispensing device as described in case WO 2007/051989. The delivery cartridge is to be placed in an auto-dosing delivery device, such as that described in WO 2008/053191.

EXAMPLES

Four automatic dishwashing compositions; Composition 1 (low pH, low nonionic surfactant and cationic polymer), Composition 2 (low pH, high nonionic surfactant and cationic polymer), Composition 3 (high pH, low nonionic surfactant and cationic polymer), Composition 4 (low pH, high nonionic surfactant and cationic polymer) were made as detailed herein below.

Test Method

An automatic dishwashing composition was made according to the below.

I. Preparation of Test Compositions

Tests were carried out using the following detergent compositions:

| | Level (% wt) Solid composition | |
|---|---|---|
| Ingredient | 1 | 2 |
| Sodium citrate | 23 | 16 |
| 2-pyridinol-1-oxide | 3 | 2 |
| Citric acid | 19 | 14 |
| Sodium 1-hydroxyethyidene-1,1-diphosphonate | 4 | 3 |
| Sodium percarbonate | 21 | 16 |
| Sodium carbonate | 0 | 26 |
| Protease granule (8-10% active) | 5 | 4 |
| Amylase granule (1.4% active) | 4 | 3 |
| Processing Aids | Balance to 100% | |

| | Liquid composition 1 |
|---|---|
| Ingredient | Level (% wt) |
| Lutensol ® TO 7 (non-ionic surfactant supplied by BASF) | 36 |
| Plurafac ® SLF180 (non-ionic surfactant supplied by BASF) | 30 |
| Lutensol ® FP 620 | 11 |
| Glycerine | 1 |

-continued

| Ingredient | Liquid composition 1 Level (% wt) |
|---|---|
| Di propylene glycol | 16 |
| Processing Aids | Balance to 100% |

A 1% solution of compositions 1 and 2 in deionsed water at room temperature had a pH of 6.5, while a 1% solution of compositions 3 and 4 had a pH of 10.5

II. Test Stains

The test stains used were ceramic side plates soiled with a meat and egg mixture, prepared using the following procedure (taken from Methods for Ascertaining the Cleaning Performance of Dishwasher Detergents (Part B, updated 2005) from the IKW working group automatic dishwashing detergents):

| Ingredient | % content |
|---|---|
| Lean (<5% fat) Minced Pork | 30.9 |
| Lean (<5% fat) Minced Beef | 30.9 |
| Egg | 18.5 |
| Water | 19.7 |
| Total | 100 |

1. Weigh out the appropriate amounts of each ingredient.
2. Whisk eggs.
3. Add minced meat to whisked eggs and mix using a blender for ten minutes.
4. Add water and blend for a further five minutes.
5. Using a fork, spread 3 g of the minced meat/egg/water mixture onto a white porcelain plate (Azberg white porcelain plate, 19 cm diameter) leaving an unsoiled margin of thumb-width around the rim.
6. Place the plates into an oven preheated to 130° C. for two hours.
7. Allow plates to cool before testing.

III. Additional Ballast Soil 1

To add extra soil stress to the test, a blend of soils is added to the dishwasher, as prepared by the procedure described below

| Ingredient | % content |
|---|---|
| Potato Starch | 5.6 |
| Wheat Flour | 4.5 |
| Vegetable oil | 4.4 |
| Margarine | 4.4 |
| Lard | 4.4 |
| Single Cream | 9.0 |
| Baking Spread | 4.4 |
| Large Eggs | 9.0 |
| Whole Milk | 9.0 |
| Ketchup | 3.0 |
| Mustard | 4.0 |
| Benzoic acid >99% | 0.8 |
| Water (15-18 grains per US gallon) | 37.5 |
| Total | 100 |

Soil Preparation

1. Add water to the potato starch and leave to soak overnight. Then heat in a pan until the gel formed is properly inflated. Leave the pan to cool at room temperature overnight.
2. Weigh out the appropriate amounts of each ingredient.
3. Add the Ketchup and mustard to a bowl and mix vigorously until fully combined, 1 minute.
4. Melt Margarine, lard and baking spread individually in a microwave and allow to cool to room temperature then mix together.
5. Add Wheat Flour and Benzoic acid to a bowl and mix vigorously.
6. Break eggs into a bowl and mix vigorously.
7. Add vegetable oil to the eggs and stir using a hand blender.
8. Mix the cream and milk in a bowl.
9. Add all of the ingredients together into a large container and mix using a blender for ten minutes.
10. Weigh out 50 g batches of this mixture into plastic pots and freeze.

IV. Additional Ballast Soil 2

To add extra soil stress to the test, a blend of soils is added to the dishwasher, as prepared by the procedure described below

| Ingredient | % content |
|---|---|
| Lean Minced Pork | 29.6 |
| Lean Minced Beef | 29.6 |
| Egg | 19.7 |
| Water | 21.1 |
| Total | 100 |

Soil Preparation

1. Weigh out the appropriate amounts of each ingredient.
2. Whisk eggs.
3. Add minced meat to whisked eggs and mix using a blender for ten minutes.
4. Add water and blend for a further five minutes.
5. Add 5 g of the blended mixture to the bottom of a copper based stainless steel pan xxcm diameter and distribute evenly on the bottom of the pan.
6. Place the pan into an oven preheated to 200° C. for 15 minutes.
7. Allow pans to cool for 1 hour before testing V. Test Wash Procedure Automatic Dishwasher: Miele, model GSL Wash volume: 5000 ml Water temperature: 50° C.

Water hardness: 23 grains per US gallon

Detergent addition: Added into the bottom of the automatic dishwasher after the initial pre-wash is complete.

Additional ballast bottom rack: 12× dinner plates 6× side plates

Additional ballast top rack: 6× deep dishes 4× tea cups

Positioning of test soils: Bottom rack; 2× meat stained plates between ballast side plates.

Additional soil stress: 2× 50 g pots of Additional ballast soil 1 added to top rack.

2× pans soiled Additional ballast soil 2 added to top rack.

Example 1

One dose of detergent, comprising as below, was added to the automatic dishwasher.

| Example | Composition |
|---|---|
| Formula A | 14 g Solid composition 1 + 2.45 g liquid composition 1 |
| Formula B | 14 g Solid composition 1 + 4.5 g liquid composition 1 |

-continued

| Example | Composition |
|---|---|
| Formula C | 18 g Solid composition 2 + 2.45 g liquid composition 1 |
| Formula D | 18 g Solid composition 2 + 4.5 g liquid composition 1 |

A dishwasher was loaded with the above items which were washed using Formulas A, B, C and D respectively in hard water as detailed above. The items and the items were then graded on a visual scale of 1-10 where 1 is no removal and 10 is full removal of the minced meat soil.

| | Tea Cleaning Grade | Error |
|---|---|---|
| Formula A (comparative) | 4 | ±1 |
| Formula B | 6 | ±1 |
| Formula C (comparative) | 3 | ±1 |
| Formula D (comparative) | 3 | ±1 |

As can be seen only the formulation of this invention is able to deliver excellent meat cleaning.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A neutral or acidic automatic dishwashing detergent composition comprising a pH regulator system, a low temperature amylase, and a cleaning agent comprising a mixture of cleaning surfactants and soil suspending polymers wherein the soil suspending polymer comprises an ethoxylated polyalkyleneimine and wherein the weight ratio of the pH regulator system to the cleaning agent is from about 3:1 to about 1:1 system and wherein the detergent composition comprises from about 0.01% to about 5% by weight of the composition of a perfume, wherein the cleaning surfactant comprises a mixture of alcohol ethoxylated and epoxy-capped poly(oxyalkylated) alcohol non-ionic surfactants, wherein the composition comprises from about 0.25 wt % to about 6 wt % of the non-ionic surfactants wherein the amylase is in the form of a granulate, wherein the composition has a pH from 6-7, and wherein the composition is free of a bleach catalyst and bleach activator.

2. A composition according to claim 1 comprising from about 15% to about 55% by weight of the composition of the pH regulator system.

3. A composition according to claim 1 wherein the pH regulator system comprises a mixture of an acid and a conjugate salt.

4. A composition according to claim 1, further comprising from about 10% to about 40% by weight of the composition of bleach.

5. A composition according to claim 1, further comprising sodium percarbonate.

6. A composition according to claim 1 comprising;

a) from about 20% to about 50% by weight of the composition of a pH regulator system;

b) from about 11% to about 50% by weight of the composition of percarbonate;

c) from about 15% to about 25% by weight of the composition of the cleaning surfactant; and d) from about 1% to about 5% by weight of the composition of the ethoxylated polyalkyleneimine.

7. A composition according to claim 1 wherein the composition is substantially builder free.

8. A composition according to claim 1, further comprising an iron chelant wherein the iron chelant is selected from the group consisting of siderophores, catechols, enterobactin, hydroxamates, hydroxypyridinones, hydroxypyridine N-Oxides and mixtures thereof.

9. A single or multi-compartment water-soluble pouch comprising a composition according to claim 1.

10. A multi-compartment water-soluble pouch comprising a composition according to claim 1 wherein the pouch comprises a compartment comprising a powder composition and a compartment comprising a liquid composition and wherein the liquid composition comprises the cleaning agent.

* * * * *